US006296530B1

(12) United States Patent
Yoneda et al.

(10) Patent No.: US 6,296,530 B1
(45) **Date of Patent: *Oct. 2, 2001**

(54) CONNECTOR

(75) Inventors: Takahiro Yoneda, Kanagawa-ken; Hitoshi Kazuhara, Shizuoka-ken, both of (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/441,747

(22) Filed: Nov. 17, 1999

(30) Foreign Application Priority Data

Nov. 20, 1998 (JP) ..... 10-331495

(51) Int. Cl.[7] ..... H01R 13/502
(52) U.S. Cl. ..... 439/701; 439/752
(58) Field of Search ..... 439/701, 594, 439/595, 709, 715, 716, 717, 718, 752, 724, 712, 713, 714, 599

(56) References Cited

U.S. PATENT DOCUMENTS 4,243,288 * 1/1981 Lucius et al. ..... 439/399
5,419,722 * 5/1995 Onoda ..... 439/752

FOREIGN PATENT DOCUMENTS 10-021986 1/1998 (JP) .

* cited by examiner

*Primary Examiner*—Paula Bradley
*Assistant Examiner*—Ross Gushi
(74) *Attorney, Agent, or Firm*—Oblon, Spivak, McClelland, Maier & Neustadt, P.C.

(57) ABSTRACT

A connector including a first component which has a first receiving portion, and a a second component which has a first projection portion to be abuttingly engaged with the first receiving portion and which is to be pivoted about a first abutting portion of the first projection portion and the first receiving portion. Also included is a first locking member which is fixed to the second component and which is to form a first track while pivoting the second component, and a first side member which is fixed to the first component and which has on the first track a first portion to be lockingly engaged with the first locking member.

7 Claims, 3 Drawing Sheets

CONNECTOR

BACKGROUND OF THE INVENTION

1. Field of the Invention

The present invention is related to a connector where a there is assembled a wire-harness for an automobile or a terminal portion in a wiring for various electrical equipment, and more particular to a connector for stacking a plurality of connector blocks.

2. Description of Relevant Art

A conventional connector has an upper connector housing, a lower connector housing, and a cover body. There are formed first engagement projections at lower portions on both sides of the upper connector housing. There are formed at upper portions on both sides of the lower connector housing second engagement projections which are each stacked on a first engagement projection.

There are provided standing board portions on both sides of the cover body. There are formed slots to be engaged at standing boards where first and second engagement projections are inserted with being stacked on each other, thereby being engaged with the slots.

In the conventional connector, however, when the upper and lower connector housings are assembled to each other and both housings are engaged with the cover body with the first and second engagement projection being stacked each other, the first and second projections are not perfectly inserted in a slot of the cover body to be engaged, this representing improper engagement. Thus, it is impossible to assemble the first and second connector housings together securely.

In a connector where stacking blocks are stacked onto a lowest block in a multi-level configuration, the connector has a structure in which there are formed engagement portions at the lowest block, the engagement portions each being engaged with each of a plurality of stacking blocks. In this connector, a stacking block which is originally engaged with an engagement portion is engaged with another engagement portion which is to be engaged with yet another stacking block. That is, mistaken assembly occurs.

There is a case in which a worker does not visually detect a defective or mistaken assembly, and this improper condition is easily overlooked.

SUMMARY OF THE INVENTION

An object of the invention is to provide a connector in which a plurality of connector housings are properly assembled with one another by a simple assembly operation, without defective and mistaken assembly occurring.

To achieve the above-noted object, according to the present invention, a connector comprises: a first component which has a first receiving portion; a second component which has a first projection portion to be abuttingly engaged with the first receiving portion and which is to be pivoted about a first abutting portion of the first projection portion and the first receiving portion; a first looking member which is fixed to the second component and which is to form a first track while pivoting the second component; and a first side member which is fixed to the first component and which has on the first track a first portion to be lockingly engaged with the first locking member.

One of the first and second component preferably has a second receiving portion, the connector further comprising: a third component which has a second projection portion to be abuttingly engaged with the second receiving portion and which is to be pivoted about a second abutting portion of the second projection portion and the second receiving portion; a second locking member which is fixed to the third component and which is to form a second track apart from the first track while pivoting the third component; and a second side member which is fixed to one of the first and second components, and which has on the second track a second portion to be lockingly engaged with the second locking member.

The second portion is preferably closer to the second projection portion than the first track.

The second portion is preferably further from the second projection portion than the first track.

The first receiving portion is preferably formed in a step shape.

The first locking member preferably has a projection and the first portion has one of an opening portion and a recessed portion to be lockingly engaged with the projection.

The first portion preferably has a projection and the first locking member has one of an opening portion and a recessed portion to be lockingly engaged with the projection.

According to the invention, the first projection portion of the second component is abuttingly engaged with the first receiving portion of the first component, and the second component is pivoted about the first abutting portion. Further, the first locking member of the second component is lockingly engaged with the first portion. In this condition, the first receiving portion sets a pivot fulcrum of the second component. The first track of the first locking member overlaps with a position of the first portion, and the first locking member and the first portion are reliably assembled to each other.

Further, the third component is provided with a second locking member, the second locking member being apart from the first track of the first locking member. The second portion is formed on the second track of the second locking member. Thus, the first locking member is not mistakenly lockingly engaged with the second portion.

The second component is assembled by pivoting, the positions of the first locking member and the first portion remaining together, with assembly performed surely by an easy operation. Further, there is formed the second portion to be lockingly engaged with the second locking member apart from the first track of the first locking member, and the second and third component each are reliably lockingly engaged with each other without mistake.

In the invention, a projection portion is abuttingly engaged with a receiving portion, and the second and third components each are not out of a position with a lower or mating component. Thus, the components each are pivoted and assembled correctly.

In the invention, the projection of the first locking member is lockingly engaged with one of an opening and a recessed portion, and the first component and the second component are integrally held together.

In the above-mentioned invention, the first or second projection portion has a configuration including a triangular prism shape, a square prism shape, a polygonal prism shape or a semisphere shape. The first or second receiving portion has a configuration including a step shape, recess shape or wall shape extending form the first or second component to outside. The first and second side member may be integrally formed or may be separately formed. The first portion may be closer to the first component than the second portion or may be further from the first component than the second portion.

The projection has a configuration including a semishere shape, all curved surface shapes, a triangular prism shape or a polygonal prism shape. A configuration of the opening or recessed portion includes a triangular shape, a square shape, a polygonal shape or an elliptic shape.

BRIEF DESCRIPTION OF THE ACCOMPANYING DRAWINGS

DETAILED DESCRIPTION OF THE PREFERRED EMBODIMENTS

The following will describe in detail preferable embodiments of the present invention with reference to the drawings.

A connector 10 of the embodiment is chiefly composed of a lower connector housing 11 as a first component, a cover 12 as a second component, and an upper connector housing 13 as a third component. All these members are made of an electrically insulating resin.

Figure 1:
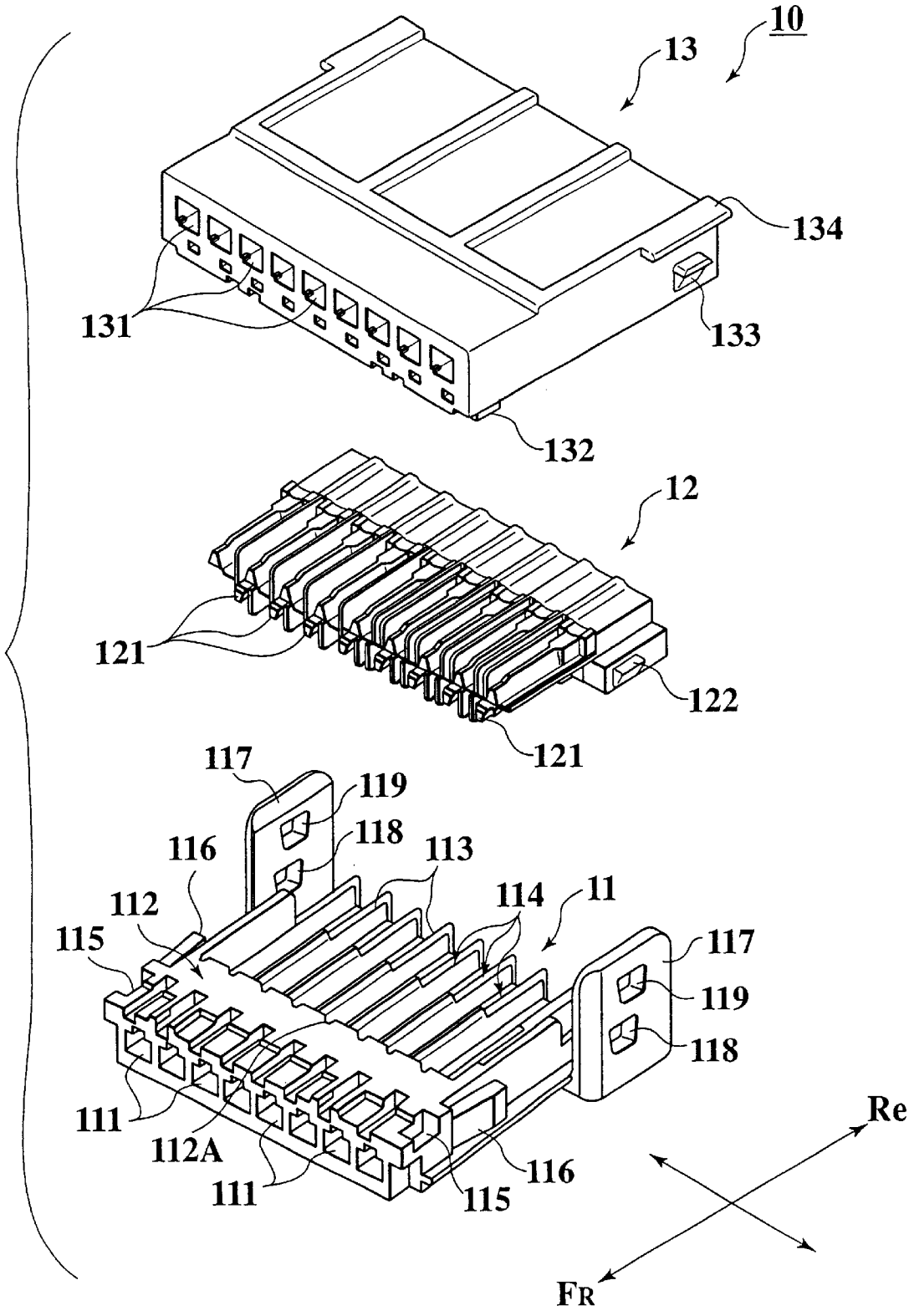
FIG. 1 is an exploded perspective view of a connector according to an embodiment.

As shown in FIG. 1, the lower connector housing 11 has a connecting pin accommodation portion 112 which is formed with a plurality of terminal opening portions 111 at a front end side and a plurality of terminal fitting accommodation portions 114 at a rear end side which are partitioned by a plurality of partition walls 113. On both sides in an upper portion of the connecting pin accommodation portion 112, each supportable recessed section 115 is formed. On a rear end of the supportable recessed section 115, an elastic engagement piece 116 is formed so as to be lockingly engaged with another connector not shown in the drawings or with a female connector. Further, on both sides in a rear end of the lower connector housing 11, there are side pieces 117 with elasticity which stand in each stack direction, as a first and second side member.

Figure 2:
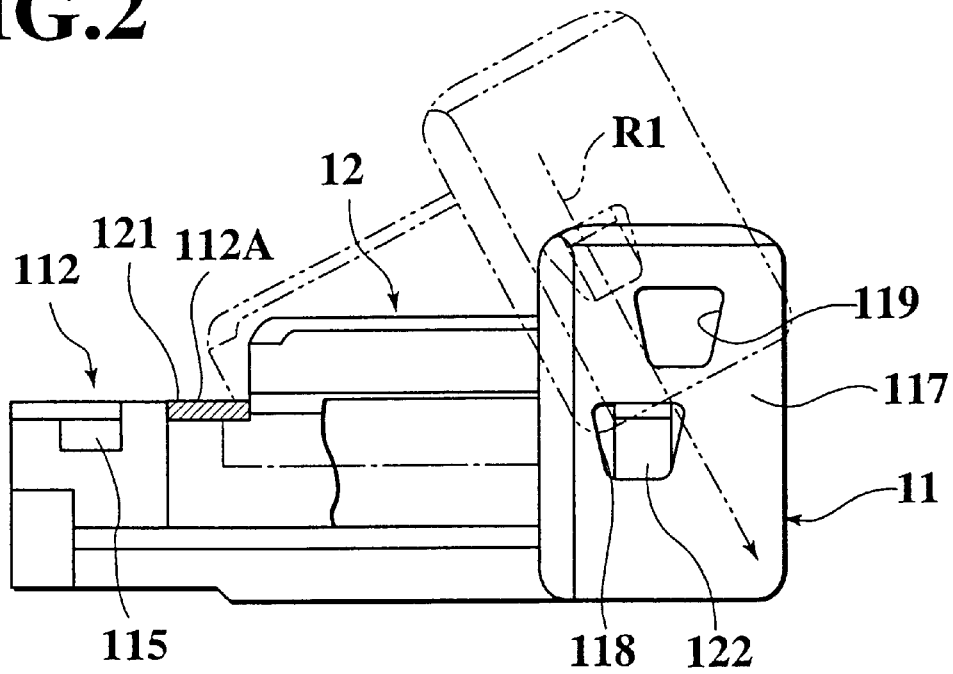
FIG. 2 is a explanatory side view which shows a condition of assembling a lower connector housing with a cover.
Figure 3:
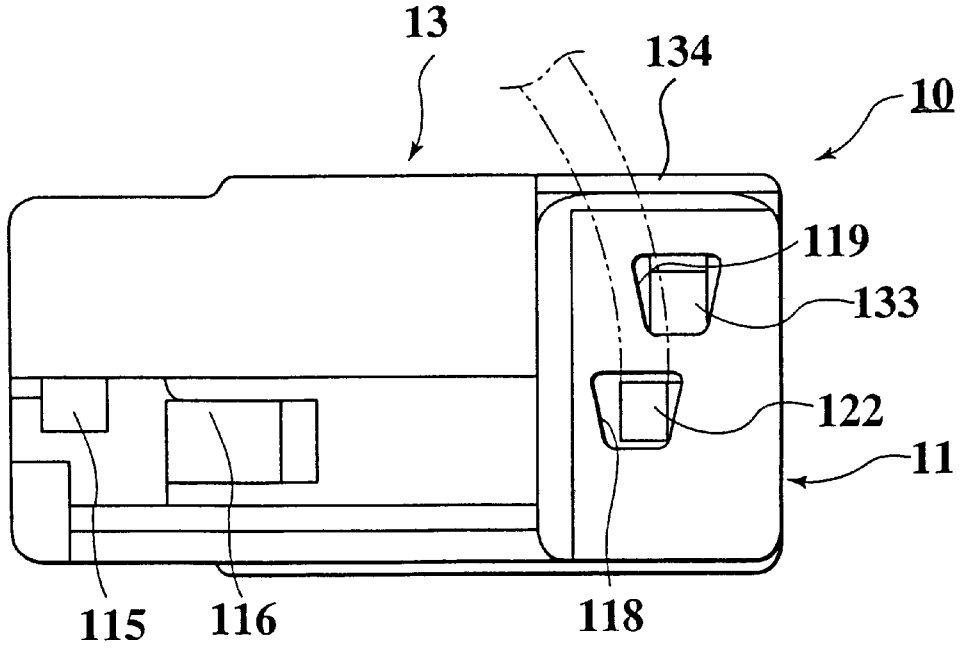
FIG. 3 is a side view of a connector which shows assembling condition.

As shown in FIGS. 2 and 3, these side pieces 117 each are separately formed with a lower opening 118 as a first portion and an upper opening 119 as a second portion. The lower opening 118 is formed in the vicinity of an upper face height position of the lower connector housing 11. The upper opening 119 is formed higher than the lower opening 118 by a predetermined dimension and is formed on a rear side of the lower connector housing 11 relative to the lower opening 118. There is formed the upper opening 119 outside a pivot locus R1, as a first locus, of a first locking projection 122 on the cover 12 as described later, the upper opening 119 configured to be lockingly engaged with a second locking projection 133, or a second locking member, on the upper connector housing 13.

Figure 4:
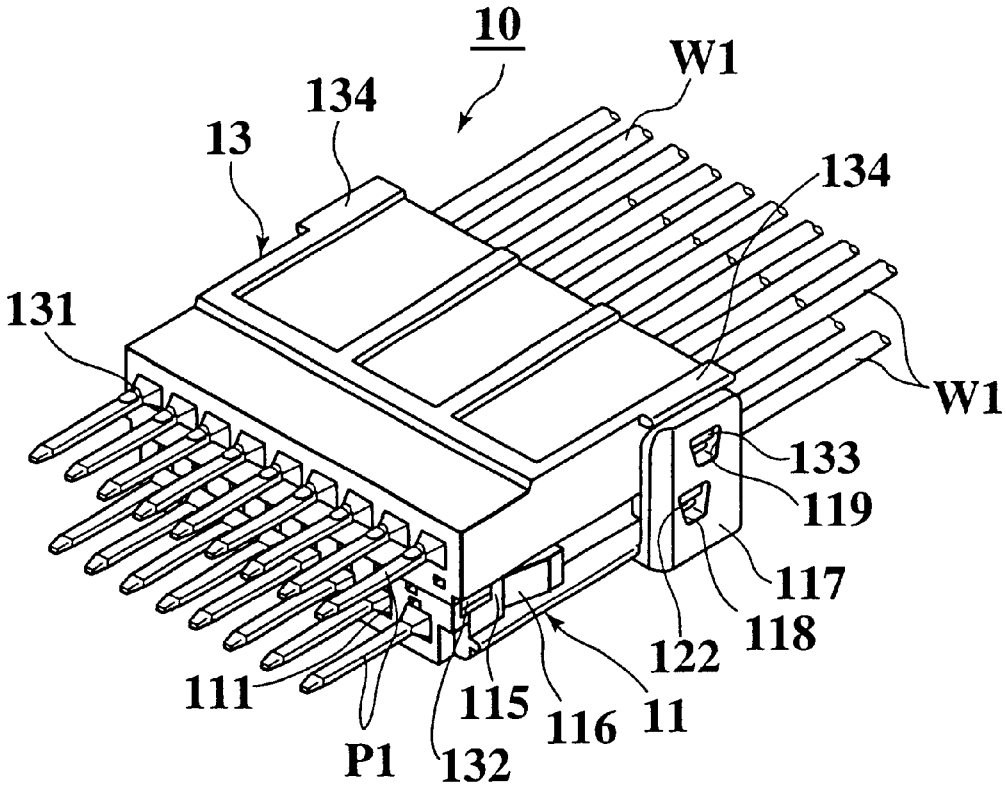
FIG. 4 is a perspective view of a connector which shows assembling condition in which a terminal fitting is mounted to a wire-harness.
Figure 5:
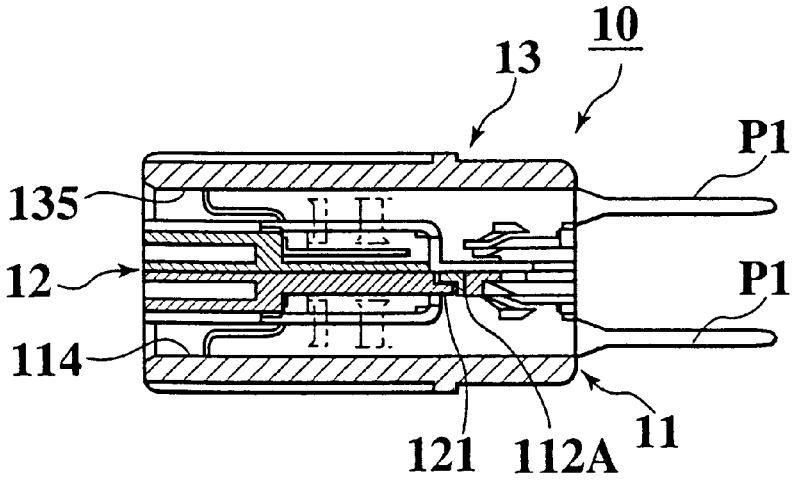
FIG. 5 is a cross-sectional view of a connector showing assembling condition.

As shown in FIGS. 4 and 5, in such a structural connector housing 11, connecting pins P1 each are inserted from a side of a terminal fitting accommodation portion 114 to be held, with projection from the terminal opening portion 111. In the terminal fitting accommodation 114, there is inserted a terminal fitting not shown in the drawing to be arranged. As shown in FIG. 4, the terminal fitting is connected with each end of wire-harnesses W1 to be held.

The cover 12 covers an upper portion of the terminal fitting accommodation portion 114 in the lower connector housing 11 as above-described, so that it electrically insulates upper wire-harnesses W1 and lower wire-harnesses W1 from each other, the upper wire-harnesses W1 being inserted to be arranged in the upper connector housing 13, the lower wire-harnesses W1 being inserted so as to be accommodated in the lower connector housing 11.

There are provided each first support projection portions 121, or a first projection portion, at a lower portion of a front end in the cover 12, the first support projection portions 121 each to be abutted to a rear end of upper wall portion 112A in a connecting pin accommodation portion 112, and being the same in number as the terminal fitting accommodation portions 114. There are formed at lower portions of both sides on a rear side in the cover 12 a pair of locking projections 122 projecting to each side direction. The locking projections 122 each are set at a position where being inserted in lower opening 118 of the side piece 117 to be lockingly engaged with, when the cover 12 is pivoted about an abutting portion as a fulcrum to be stacked on the lower connector housing 11 in a state where the first support projection portion 121 of the cover 12 enters under a rear end of an upper wall portion 112A in the connecting pin accommodation portion 112 thereby being abuttingly engaged. The first support projection portion 121 is engaged with a hole under the upper wall portion 112A and a front end portion of the first projection portion 12 abuts to a rear end of the upper wall portion 112A to set a pivot fulcrum of the cover 12. A first receiving portion corresponds to the rear end portion of the upper wall portion 112A and the hole under the upper wall portion 112A.

The upper connector housing 13 is formed with a plurality of terminal opening portions 131, of which connecting pins P1 project from a front end. Connecting pins P1 each are inserted from a rear end side of a terminal fitting accommodation portion 135 formed inside the housing 13, as shown in FIG. 5. At both sides of a lower portion at a front end of the upper connector housing 13, there are provided downward each second support projection portion 132, or second projection portion, which are inserted in each supportable recessed section 115, or a second receiving portion, formed in the lower connector housing 11 to act as a fulcrum.

Further, at both side faces of rear end side in the upper connector housing 13, there is provided a pair of second locking projections 133 each projecting in a side direction, the projections 133 to be lockingly engaged with upper openings 119 of side pieces 117 of a lower connector housing 11. Above the second locking projections 133, there are formed abutting engagement plate portions 134 so as to project in a side direction, the plate portions 134 to be abuttingly engaged with upper portions of the side pieces 117.

An assembling method for such a structural connector 10 is explained with reference to FIGS. 2 and 3. It is noted that FIGS. 2 and 3 show the condition in which connecting pins P1, terminal fittings, and wire-harnesses W1 are not assembled, to simplify the explanation.

First, when a cover 12 is assembled to a lower connector housing 11, the first support projection portion 121 at a front end of the cover 12 is entered under a rear end of an upper wall portion 112A in a connecting pin accommodation portion 112 of the lower connector housing 11, thus being abuttingly engaged with it. Then, the cover 12 is pivoted about this abutting portion as a fulcrum in the clockwise direction as shown in FIG. 2. The first locking projection 122 of the cover 12 is fitted in, or lockingly engaged with, the lower opening 118 formed in a side piece 117 in the lower connector housing 11.

When this is done, outside the pivot locus R1 formed by the first locking projection 122 of the cover 12, there is formed an upper opening 119, and the first locking projection 122 is not lockingly engaged with the upper opening 119 by mistake, thereby preventing mistaken assembly.

When the first locking projection 122 is abutted to an upper portion of the side piece 117, the projection 122 slides on an inner side face of a side piece 117 with the side piece 117 being pushed to be spread in a side direction, thereby reaching to the lower opening 118. Next, when the first locking projection 122 is fitted into the lower opening 118, the side piece 117 returns to an original position by restitution force, thereby generating sound of engagement of the side piece 117 and a cover 12.

In this way, when the first locking projection 122 is fitted in the lower opening 118*a,* the first engagement piece 117 returns to an original position to cause engagement sound, and reliably performing engagement is confirmed and identified without viewing. It is noted that the lower opening 118 is open, and it is able to confirm engagement state by viewing.

Next, as shown in FIG. 3, when an upper connector housing is assembled, the second support projection portion 132 of the upper connector housing 13 is inserted into the supportable recessed section 115 of a lower connector housing 11 to be abuttingly engaged with. In this state, shown in FIG. 3, the upper connector housing 13 is pivoted about this abutting engagement portion as a fulcrum in the clockwise direction, and the second locking projection 133 is fitted in, or lockingly engaged with, the upper opening 119 of the side piece 117. When the second locking projection 133 is fitted into the lower opening 119, engagement is confirmed by an engagement sound. FIGS. 4 and 5 shows the assembled state of the connector 10.

The above describes a preferred embodiment of the present invention. The present invention is not restricted, however to the above-described embodiment, and can take on various forms and designs within which are encompassed by the described constitution. For example, while in the above-mentioned embodiment, openings are opened in the side piece 117 and locking projections are provided on sides of the cover 12 and the upper connector housing 13, the locking projection may also be formed on a side of the side piece 117, and an opening or a recessed portion may be formed in the lower connector housing 11 or in the cover 12.

In the above-described embodiment, the connector 10 of the invention is applied to a male connector. However, the invention may be applied to a female connector or other structural connector.

Further, in the embodiment, it is explained that composition members are a lower connector housing 11, the cover 12, and the upper connector housing 13. Number and configuration of the composition members as a stacking block are not restricted by the embodiment described while.

In the embodiment, the upper connector housing 13 is engaged with a lower connector housing 11 to be supported, the upper housing 13 may be alternately supported by the cover 12.

What is claimed is:

1. A connector comprising:

a first component having a first recessed receiving portion;

a second component having a first projection portion with a forwardly-extending front end portion configured to abuttingly engage with the first recessed receiving portion, and in which the second component is configured to pivot about a first abutting portion of the first projection portion and the first recessed receiving portion;

a first locking member fixed to the second component and forming a first track while the second component is pivoted;

a first side member fixed to the first component and having on the first track a first portion configured to lockingly engage with the first locking member;

a third component having a second projection portion configured to abuttingly engage with a second recessed receiving portion included in one of the first and second components, and in which the third component is configured to pivot about a second abutting portion of the second projection portion and the second recessed receiving portion;

a second locking member fixed to the third component and forming a second track apart from the first track while the third component is pivoted; and a second side member fixed to one of the first and second components and having on the second track a second portion configured to lockingly engage with the second locking member, wherein the second component is sandwiched between the first and third components.

2. A connector according to claim 1, wherein the second portion is closer to the second component than the second portion is to the first component.

3. A connector according to claim 1, wherein the second portion is further from the second component than the second portion is to the first component.

4. A connector according to claim 1, wherein the first recessed receiving portion comprises a step shape.

5. A connector according to claim 1, wherein the first locking member has a projection and the first portion has one of an opening portion and a recessed portion to be lockingly engaged with the projection.

6. A connector according to claim 1, wherein the first portion has a projection and the first locking member has one of an opening portion and a recessed portion to be lockingly engaged with the projection.

7. A connector according to claim 1, wherein a distance between the first abutting portion and the second portion is different from that between the first abutting portion and the first portion, and a distance between the second abutting portion and the second portion is different from that between the second abutting portion and the first portion.

* * * * *

UNITED STATES PATENT AND TRADEMARK OFFICE

CERTIFICATE OF CORRECTION

PATENT NO. : 6,296,530 B1
DATED : October 2, 2001
INVENTOR(S) : Takahiro Yoneda et al.

It is certified that error appears in the above-identified patent and that said Letters Patent is hereby corrected as shown below:

Column 1,
Line 6, please delete "a" after "where".

Column 2,
Line 62, change "form" to -- from --.

Column 5,
Line 31, change "a" to -- the --;
Line 39, change "shows" to -- show --.

Signed and Sealed this

Twelfth Day of March, 2002

*Attest:*

*Attesting Officer*

JAMES E. ROGAN
*Director of the United States Patent and Trademark Office*